US009702204B2

(12) United States Patent
MacDonald et al.

(10) Patent No.: US 9,702,204 B2
(45) Date of Patent: Jul. 11, 2017

(54) CONTROLLED PRESSURE PULSER FOR COILED TUBING MEASUREMENT WHILE DRILLING APPLICATIONS

(71) Applicant: TELEDRILL, Inc., Katy, TX (US)

(72) Inventors: Robert MacDonald, Houston, TX (US); Gabor Vecseri, Houston, TX (US)

(73) Assignee: Teledrill, Inc., Katy, TX (US)

( * ) Notice: Subject to any disclaimer, the term of this patent is extended or adjusted under 35 U.S.C. 154(b) by 511 days.

(21) Appl. No.: 14/255,763

(22) Filed: Apr. 17, 2014

(65) Prior Publication Data

US 2015/0300153 A1 Oct. 22, 2015

(51) Int. Cl.

| | |
|---|---|
| ***E21B 47/18*** | (2012.01) |
| ***E21B 47/12*** | (2012.01) |
| ***E21B 17/20*** | (2006.01) |

(52) U.S. Cl.

CPC ..... *E21B 17/20* (2013.01); *E21B 47/187* (2013.01)

(58) Field of Classification Search

CPC ... E21B 1/00; E21B 4/06; E21B 47/18; E21B 47/187; E21B 47/12

See application file for complete search history.

(56) References Cited

U.S. PATENT DOCUMENTS

| | | | |
|---|---|---|---|
| 2,397,070 | A | 3/1946 | Zublin |
| 2,797,893 | A | 7/1957 | McCune et al. |
| 2,858,107 | A | 10/1958 | Colmerauer |
| 3,958,217 | A | 5/1976 | Spinner |
| 4,436,165 | A | 3/1984 | Emery |
| 4,807,704 | A | 2/1989 | Hsu et al. |
| 4,901,290 | A | 2/1990 | Feld et al. |
| 5,009,272 | A | 4/1991 | Walter |
| 5,040,155 | A | 8/1991 | Feld |
| 5,190,114 | A | 3/1993 | Walter |
| 5,508,975 | A | 4/1996 | Walter |

(Continued)

FOREIGN PATENT DOCUMENTS

| | | |
|---|---|---|
| CA | 2609922 | 5/2011 |
| WO | 2006041499 A2 | 4/2006 |

(Continued)

OTHER PUBLICATIONS

K. Mazerov, Coiled Tubing Pushing Its Limits By Going bigger, Expanding Niche Applications, Thinking Riserless, www.DrillingContractor.org, 2011, 1-3, US.

*Primary Examiner* — Catherine Loikith

(74) *Attorney, Agent, or Firm* — Guerry L. Grune; ePatentManager

(57) ABSTRACT

An apparatus and system for generating pressure pulses for enhancing and completing a well bore within a coiled tubing assembly including: a CT-MWD-FTD tool longitudinally and axially positioned within the center of a main valve assembly including a main valve. The drilling fluid is subsequently split into both an inlet main fluid stream and a pilot fluid stream, wherein the pilot fluid stream subsequently flows such that the pilot fluid recombines with the main flow stream to become a main exit fluid flow. The main exit fluid flow then proceeds toward a motor housing wherein one or more annular pressure sensors measure the pressure of fluid flow with sensors that send signals to a Digital Signal Processor (DSP) that controls flow throttling devices which generate controllable, large, rapid and measurable energy pulses.

14 Claims, 6 Drawing Sheets

(56) References Cited

U.S. PATENT DOCUMENTS

| | | | |
|---|---|---|---|
| 5,626,016 | A | 5/1997 | Walter |
| 6,002,643 | A | 12/1999 | Tchakarov et al. |
| 6,053,261 | A | 4/2000 | Walter |
| 6,082,473 | A | 7/2000 | Dickey |
| 6,102,138 | A | 8/2000 | Fincher |
| 6,237,701 | B1 | 5/2001 | Kolle et al. |
| 6,279,670 | B1 | 8/2001 | Eddison et al. |
| 6,338,390 | B1 | 1/2002 | Tibbitts |
| 6,439,316 | B1 | 8/2002 | Penisson |
| 6,508,317 | B2 | 1/2003 | Eddison et al. |
| 6,588,518 | B2 | 7/2003 | Eddison |
| 6,668,948 | B2 | 12/2003 | Buckman et al. |
| 6,840,337 | B2 | 1/2005 | Terry et al. |
| 6,997,272 | B2 | 2/2006 | Eppink |
| 7,011,156 | B2 | 3/2006 | Von Gynz-Rekowski |
| 7,032,689 | B2 | 4/2006 | Goldman et al. |
| 7,051,821 | B2 | 5/2006 | Samuel |
| 7,100,708 | B2 | 9/2006 | Koederitz |
| 7,139,219 | B2 | 11/2006 | Kolle et al. |
| 7,180,826 | B2 | 2/2007 | Kusko et al. |
| 7,836,948 | B2 | 11/2010 | Kusko et al. |
| 7,958,952 | B2 | 6/2011 | Kusko et al. |
| 8,138,943 | B2 | 3/2012 | Kusko et al. |
| 2006/0072374 | A1 | 4/2006 | Kusko |
| 2009/0107723 | A1 | 4/2009 | Kusko et al. |
| 2010/0147525 | A1 | 6/2010 | Lerner et al. |
| 2013/0048300 | A1 | 2/2013 | MacDonald et al. |
| 2013/0048379 | A1 | 2/2013 | MacDonald et al. |

FOREIGN PATENT DOCUMENTS

| | | | |
|---|---|---|---|
| WO | 2008091688 | A2 | 8/2008 |
| WO | 2008136883 | A1 | 11/2008 |

CONTROLLED PRESSURE PULSER FOR COILED TUBING MEASUREMENT WHILE DRILLING APPLICATIONS

PRIORITY DOCUMENTS

This application takes priority from and is a continuation of U.S. application Ser. No. 13/336,981 filed Dec. 23, 2011 entitled "Controlled Pressure Pulser for Coiled Tubing Applications" and corresponding PCT Application PCT/US12/24898 filed Feb. 13, 2012 of the same title. This application also takes priority from and is a continuation-in-part of U.S. application Ser. No. 13,368,150 entitled "Full Flow Pulser for Measurement While Drilling (MWD) Device, filed on Feb. 2, 2012 and corresponding Provisional application 61/529,329 filed on Aug. 31, 2011 of the same title. Priority is also claimed to U.S. application Ser. No. 13/368,997 filed Aug. 21, 2012 and PCT Application number PCT/US13/25323 filed Feb. 8, 2013, both entitled "Controlled Pressure Pulser for Measurement While Drilling (MWD) Device" of which this application is a continuation. Priority is claimed to U.S. Pat. No. 7,958,952 entitled "Pulse Rate of Penetration Enhancement Device & Method", granted Jun. 14, 2011 which is a continuation-in-part of U.S. Pat. No. 7,836,948 entitled "Flow Hydraulic Amplification Device for Pulsing, Fracturing and Drilling" granted Nov. 23, 2010, and the original provisional application 60/927,400 filed May 7, 2010 and to which priority is also claimed.

FIELD OF DISCLOSURE

The current invention includes a Coiled Tubing Measurement While Drilling Flow Throttling Device (CT-MWD-FTD), herein referred to as "the tool", and a method for controlling a pulse created within drilling fluid or drilling mud traveling along the internal portion of a coiled tubing (CT) string. The pulse is normally generated by the use of a pulser, selectively initiating flow driven bi-directional pulses due to proper geometric mechanical designs within a pulser.

A telemetric pulse signal is received at the surface from the use of the tool down hole and includes information necessary for the field personnel during the well operation. At the same time, the telemetric pulses produced by the pulser also create momentary axial loads on the bottom hole assembly (BHA) and along the coiled tubing string, thus reducing friction and enhancing extended reach within the wellbore.

BACKGROUND

This invention relates generally to the completion of wellbores. More particularly, this invention relates to new and improved methods and devices for completion, deepening, fracing, reentering and plug milling of the wellbore. This invention finds particular utility in the completion of horizontal wells. Notwithstanding previous attempts at obtaining cost effective and workable horizontal well completions, there continues to be a need for increasing horizontal well departure to increase, for example, unconventional shale plays—which are wells exhibiting low permeability and therefore requiring horizontal laterals increasing in length to maximize reservoir contact. With increased lateral length, the number of zones fractured increases proportionally.

Most of these wells are fractured using the "Plug and Perf" method which requires perforating the stage nearest the toe of the horizontal section, fracturing that stage and then placing a composite plug followed by perforating the next stage. The process is repeated numerous times until all the required zones are stimulated. Upon completing the fracturing operation, the plugs are removed with a positive displacement motor (PDM) and mill/bit run on coiled tubing (CT). As the lateral length increases, milling with coiled tubing becomes less efficient, leading to the use of jointed pipe for removing plugs.

Two related reasons cause this reduction in efficiency of the CT. First, as the depth increases, the effective maximum weight on bit (WOB) decreases. Second, at increased lateral depths, the coiled tubing is typically in a stable helical spiral in the wellbore. The operator sending the additional coiled tubing (and weight from the surface) will have to overcome greater static loads leading to a longer and inconsistent transmission of load to the bit. The onset of these two effects is controlled by several factors including; CT wall thickness, wellbore deviation and build angle, completion size, CT/completion contact friction drag, fluid drag, debris, and bottom hole assembly (BHA) weight and size. CT with an outer diameter less than 4 inches tends to buckle due to easier helical spiraling, thus increasing the friction caused by increased contact surface area along the wall of the bore hole. CT outer diameters greater than 4 inches are impractical due to weight and friction limitations. Friction drag is a function of CT wall thickness and diameter, leaving end loads as one of the variables most studied for manipulation to achieve better well completion.

SUMMARY

The need to effectively overcome these challenges regarding both lateral reach and improved plug milling efficiency has led to the development of the CT-MWD-FTD tool of the present disclosure. The tool allows for improved methods that provide better well completions, achieving extended reach, communicating operational information, better rate and direction of penetration with proper WOB, as well as providing for controlled pulsing in an as-needed (on demand) manner.

Current pulser technology utilizes pulsers that are sensitive to different fluid properties, down hole pressures, and flow rates, and require field adjustments to pulse properly so that meaningful signals from these pulses can be received and interpreted uphole using Coiled Tubing (CT) technology. Newer technology incorporated with CT has included the use of water hammer devices producing a force when the drilling fluid is suddenly stopped or interrupted by the sudden closing of a valve. This force created by the sudden closing of the valve can be used to pull the coiled tubing deeper into the wellbore. The pull into the wellbore is created by increasing the axial stress in the coiled tubing and straightening the tubing due to momentary higher fluid pressure inside the tubing and thus reducing the frictional drag. This task—generating the force by opening and closing valves—can be accomplished in many ways—and is also the partial subject of the present disclosure. To date, there is no other positive pulse pulser for CT outside of the present disclosure.

The present disclosure and associated embodiments allow for providing a pulser system within coiled tubing string such that the pulse amplitude increases with flow rate or overall fluid pressure within easily achievable limits, does not require field adjustment, and is capable of creating recognizable, repeatable, reproducible, clean [i.e. noise free] fluid pulse signals using minimum power due to a unique design feature. The tool utilizes battery, magneto-electric and/or turbine generated energy to provide measurement while drilling (MWD), as well as controlled rate of penetration (ROP) capabilities, telemetry and axial agitation within the CT using the CT-MWD-FTD tool of the present disclosure.

Additional featured benefits of the present device and associated methods include using a pulser tool above the PDM (positive displacement motor) allowing for intelligence gathering, transmitting and storing of real time data in memory such as bore and annular pressure, acceleration, temperature, torque and weight-on-bit (WOB) controls. The WOB is controlled by using a set point and threshold for the axial force provided by the shock wave generated by the pulser. Master control is provided from the surface via downlinking to the tool, or with a feedback loop preprogrammed into the tool to automatically adjust its settings to adjust for specific conditions.

The coiled tubing industry continues to be one of the fastest growing segments of the oilfield services sector, and for good reason. CT growth has been driven by attractive economics, continual advances in technology, and utilization of CT to perform an ever-growing list of field operations. The economic advantages of the present invention include; pulse only when needed (on demand) and with as much amplitude as needed, increased efficiency of milling times of the plugs by intelligent down-hole assessments, extended reach of the CT to the end of the run, allowing for reduction of time on the well and more efficient well production, reduced coiled fatigue by eliminating or reducing CT cycling (insertion and removal of the CT from the well), high pressure pulses with little or no kinking and less friction as the pulses are fully controlled, and a lower overall power budget due to the use of the intelligent pulser.

More specifically, an apparatus for generating pressure pulses in a drilling fluid that is flowing, enhancing, and completing a well bore within a coiled tubing assembly comprises: a CT-MWD-FTD tool longitudinally and axially positioned within the center of a main valve assembly including a main valve wherein the main valve assembly also comprises a main valve pressure chamber, and a main valve orifice with a main valve, such that the drilling fluid splits into both an inlet main fluid stream and a pilot fluid stream. The pilot fluid stream flows through a pilot flow upper annulus, through a pilot flow lower annulus and into a pilot flow inlet channel, wherein the pilot fluid then flows into a main valve fluid feed channel until it reaches the main valve pressure chamber. The pilot fluid flows into the main valve fluid feed channel through a pilot flow outlet channel and recombines with a main flow to become a main exit flow fluid such that the main exit flow fluid then passes around a coupling mechanism toward a motor housing and wherein one or more annular pressure sensors measuring the pressure of flowing fluid is located inside a sensor sub assembly enabling sensors to control flow throttling devices to generate controllable, large, rapid pulses.

Additionally, the pulses provide for well-developed signals easily distinguished from any noise resulting from other vibrations due to nearby equipment within the borehole or exterior to the borehole, or within the coiled tubing assembly, wherein the signals also are capable of providing indications regarding dimensions of height, width and shape of the pulses.

Further, a mating area for electrical wiring of the annular pressure sensors exist within annular pressure ports and wherein the ports are sealed off insuring that the annular pressure sensors within the sensor sub assembly receive and sense only the annular pressure within the annular pressure ports.

In some cases the mating area for electrical wiring for the bore pressure sensors exist within bore pressure ports and wherein the ports are sealed off insuring that the bore pressure sensors within the sensor sub assembly receive and sense only bore pressure within the bore pressure ports.

The mating area for electrical wiring for weight-on-bit/axial force sensors exist within force sensor ports wherein the force sensor ports are sealed off, insuring that the force sensors within the sensor sub assembly receive and sense only a force within the force sensor ports.

The mating area for electrical wiring for torque sensors exist within torque sensor ports wherein the ports are sealed off insuring that the torque sensors within the sensor sub assembly receive and sense only torque within the torque sensor ports.

The electrical wiring for the annular pressure sensors are sealed off from flow of the main exit flow fluid and wherein the wiring is routed to and connected to an electrical connector.

The electrical wiring of the bore pressure sensors are sealed off from the flow of the main exit flow fluid and wherein the wiring is routed to and connected to an electrical connector.

The electrical wiring of the weight-on-bit/force sensors are sealed off from the flow of the main exit flow fluid and wherein the wires are routed to and connected to an electrical connector.

The electrical wiring of the torque sensors are sealed off from the flow of the main exit flow fluid and wherein the wires are routed to and connected to an electrical connector.

In an additional embodiment, a pilot valve actuator assembly is provided. The pilot valve actuator assembly is any one or more from the group consisting of; a pilot valve shaft, rotary seal shaft, rotary seals, a seal carrier, a cam shaft, pilot cams, a pilot sleeve, a pilot valve actuator assembly housing and the assembly has a pilot valve shaft.

Further, a motor is connected to the drive shaft that has pilot cams attached to the shaft and move the pilot valve actuator assembly. The pilot cams are sized and oriented within the pilot sleeve in order to allow for propelling the pilot valve actuator assembly so that pilot valve shaft can move in a bi-directional linear motion in order to seal or open inlet and outlet pilot flow channels.

Rotational motion of a motor connected to a rotating shaft that is connected to and moves the pilot cams, causes channeling of the pilot fluid toward the main valve. This channeling of the fluid causes the main valve to close and also allows for the pilot fluid to move the main valve. Consequently, the motor can reverse rotational direction. The pilot cams subsequently reverse the position of the pilot valve actuator assembly and the main valve opens, therefore returning to its original (open) position causing an end to the single positive pulse so that the entire process can begin again.

In this case, the apparatus generates fluid pulses such that the CT-MWD-FTD tool using the pilot valve actuator assembly provides either unidirectional or bi-directional rotary movement of the pilot valve shaft within the pilot valve actuator assembly housing.

Further, the apparatus provides a flow path allowing flow of the pilot fluid through the pilot valve actuator assembly, that channels the pilot fluid toward the main valve resulting in operation of the main valve bi-directionally along the moving axis.

In an additional embodiment, differential pressure is maximized by using a flow cone. The flow cone is provided within the main valve section and provides for increasing the velocity of the drilling fluid through the main valve section. This increase in velocity causes an increase in the pressure differential and also allows for better control of the energy pulses created by opening and closing of the main valve by using the pilot valve actuator assembly.

In a related embodiment, a system comprising an intelligent pulser operation sequence within a coiled tubing apparatus for enhanced well bore completion within a well bore comprising;

(i) a fluid drilling pump creating fluid flow at a predetermined base line bore pressure contained entirely within a drill string containing a bore pipe pressure sensor for sensing pressure increases of the fluid flow;

(ii) an annular pressure sensor located on the outer annular portion of a drill pipe, a bore pressure sensor within an interior flow area of the drill pipe, and an axial force sensor measuring weight-on-bit load, torque sensor, casing collar locator, gamma and other sensors wherein all sensors are located within the sensor sub assembly and are sending information to a digital signal processor (DSP) , with information being sent to the DSP before, during or after pulser operation.

For this embodiment, pre-programmed logic embedded in computer software controlling DSP based upon an input signal from sensors determines via processing correct pulser operation settings and sends information to a pulser motor controller that controls adjustment of a stepper motor current draw, response time, acceleration, duration, and revolutions to correspond with pre-programmed flow pulser settings from the DSP. Pre-programmed logic embedded in computer software is controlling the DSP based upon an input signal to the DSP from sensors that determine via signal processing, pulser operational settings and wherein settings are manipulated by the DSP when it sends signals to a pulser motor controller that controls adjustment of stepper motor parameters according to values generated by the group consisting of motor current draw, motor response time, motor acceleration, pressure pulse duration, and motor shaft revolutions.

Flow pulses are developed using a pilot actuator assembly responding exactly to a pulser motor controller that operates opening and closing of a main valve located within the wellbore thereby controlling fluid flow through the pilot valve actuator assembly by a sequence dictated by computer software working with said DSP, thereby creating positive pressure variations of fluid pressure.

In applying this system, an annulus pressure sensor and bore pipe pressure sensor detect pressure variations due to pulsing flow within coiled tubing apparatus that is compared with pump base line pressure and sends pressure variation information to the DSP to adjust pulser operation and avoid excessive water hammer.

Force sensors and torque sensors detect load variations due to pulsing flow within the coiled tubing apparatus that is compared with base line load and sends load variation information to the DSP for determining actions to adjust pulser operations and avoid excessive water hammer.

Here, the DSP collects, records, and stores data in a computer memory device located within or remote from the DSP during operation and wherein the DSP allows for downloading and analyzing the data.

Intelligent pulser operation sequences within coiled tubing apparatus provides axial agitation allowing for friction reduction capable of logging sensor data into the computer memory device. In addition, a logging tool for data logging is provided wherein the data is down hole sensing data when no pulsing is occurring, thereby allowing for real time telemetry or when axial friction reduction agitation is required.

The coiled tubing operation and system includes a wireline connection that provides power and data communications to the coiled tubing apparatus.

Also included is a mechanical device providing for a tool that guides fluid to directly drive the pilot valve actuator assembly, actuating the main valve and creating pulses of predetermined amplitudes, rates, and duration, thereby creating axial agitation

DETAILED DESCRIPTION OF DRAWINGS

The present invention will now be described in greater detail and with reference to the accompanying drawings.

Figure 1:
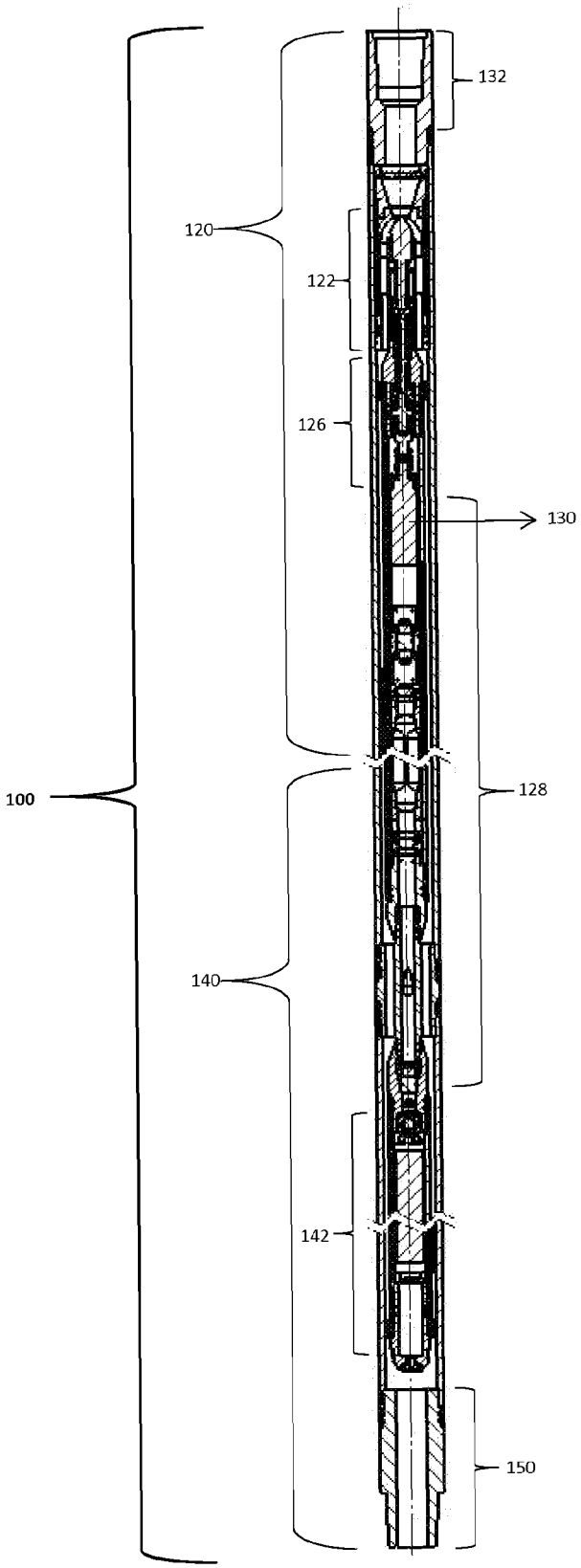
FIG. 1 is a cross-sectional view of the full flow CT-MWD-FTD tool.

With reference to FIG. 1, the complete CT-MWD-FTD tool [100] is provided as shown. The CT-MWD-FTD tool [100] has two major sections; the upper pipe portion [120] and the lower pipe portion [140]. Sections of the CT-MWD-FTD tool [100] assembly housed within the upper pipe portion [120] include the main valve section [122], the pilot valve section [126], and a portion of the electronics section [128] to include the motor [130].

At the top of the upper pipe portion [120], the CT-MWD-FTD tool [100] connects to the coiled tubing [not shown] via the upper string connection [132]. In the direction of the fluid flow, as generally referenced, the fluid enters the tool at the top of the CT-MWD-FTD tool [100].

Within the electronics section [128], the connection of the upper pipe portion [120] and the lower pipe portion [140] is obtained. Sections of the CT-MWD-FTD tool [100] housed within the lower pipe portion [140] are part of the electronics section [128] and the power unit or the battery section [142]. At the lower end of the CT-MWD-FTD tool [100] is the lower string connection [150] that connects to the down hole motor driving the mill or bit.

Figure 2:
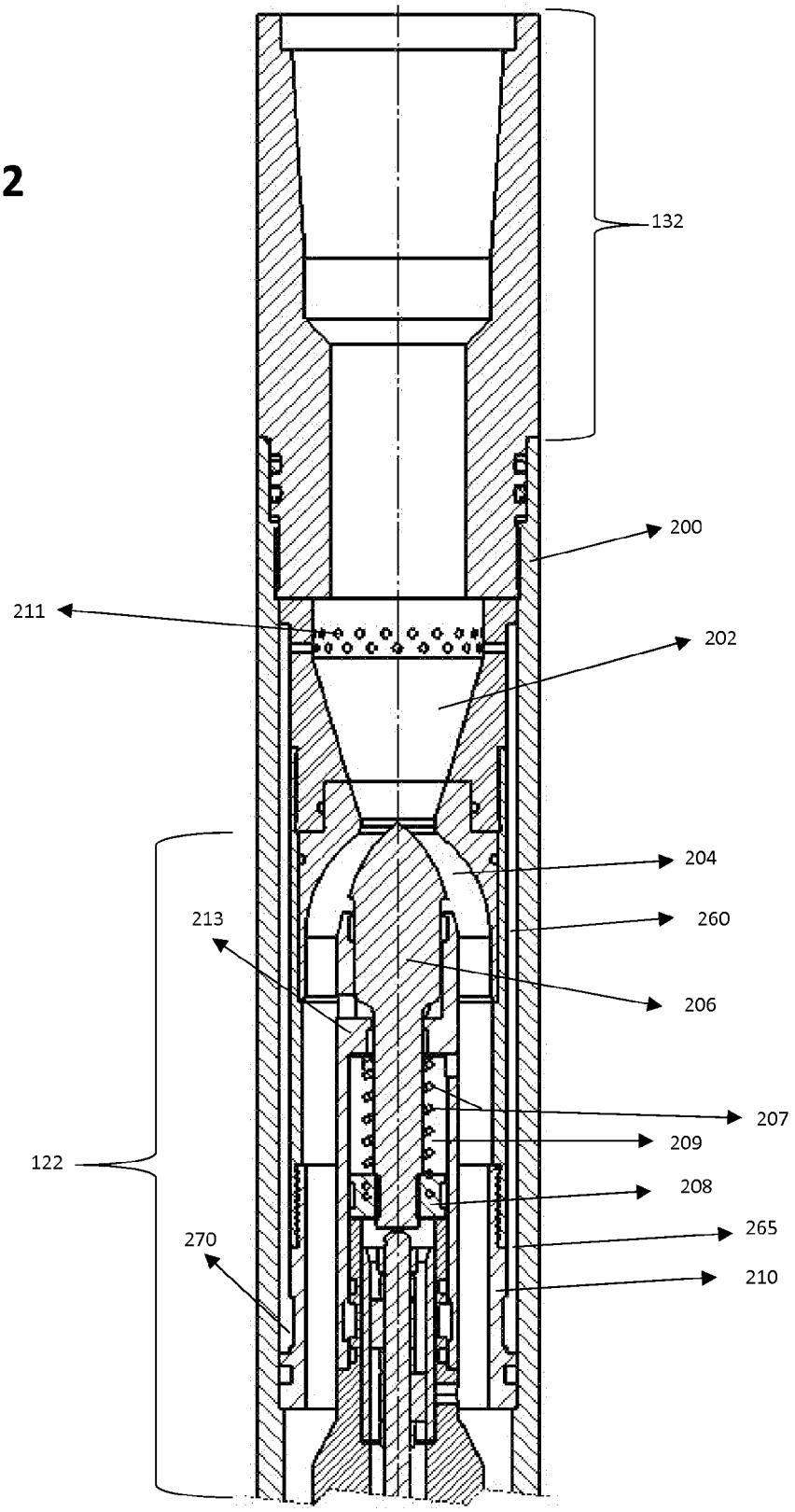
FIG. 2 is an enlarged cross-sectional view of the main valve section.

FIG. 2 provides an enlarged view of the upper string connection [132], which is fitted to the upper pipe [200], and the main valve section [122]. Fluid enters the main valve section [122] from the fluid inlet cone [202] which channels the flow of fluid to the main valve orifice [204] wherein the main valve [206], which is operated by hydraulic feed-back loop. The main valve [206] is actuated by a spring [207] assisted main valve plunger [208] which is attached to the main valve [206]. The main valve [206] and the main valve plunger [208], with spring [207], are located in the main valve housing [210] within the upper pipe [200] in the main valve section [122] and further located within the main valve pressure chamber housing [213] with the conical end of the main valve extending from the main valve pressure chamber housing [213] into the main valve orifice [204]. Within the main valve pressure chamber housing [213] is the main valve pressure chamber [209] which fully houses the spring [207] assisted main valve plunger [208].

The flow inlet cone [202] has radial apertures [211] located along the circumferential area of the flow inlet cone [202]. At the upper, larger end of the flow inlet cone [202], where a portion of the incoming fluid can enter the space between the outside of the flow inlet cone [202] and the upper pipe [200], that includes a pilot flow upper annulus [260] and the pilot flow lower annulus [265]. Pilot fluid enters the interior of the main valve housing [210] along the pulser pipe [270] through the radial apertures [211]. This pilot fluid has an increased velocity resulting in higher pressure differentials than that of the main fluid at the throat of the main valve orifice [204].

Figure 3A:
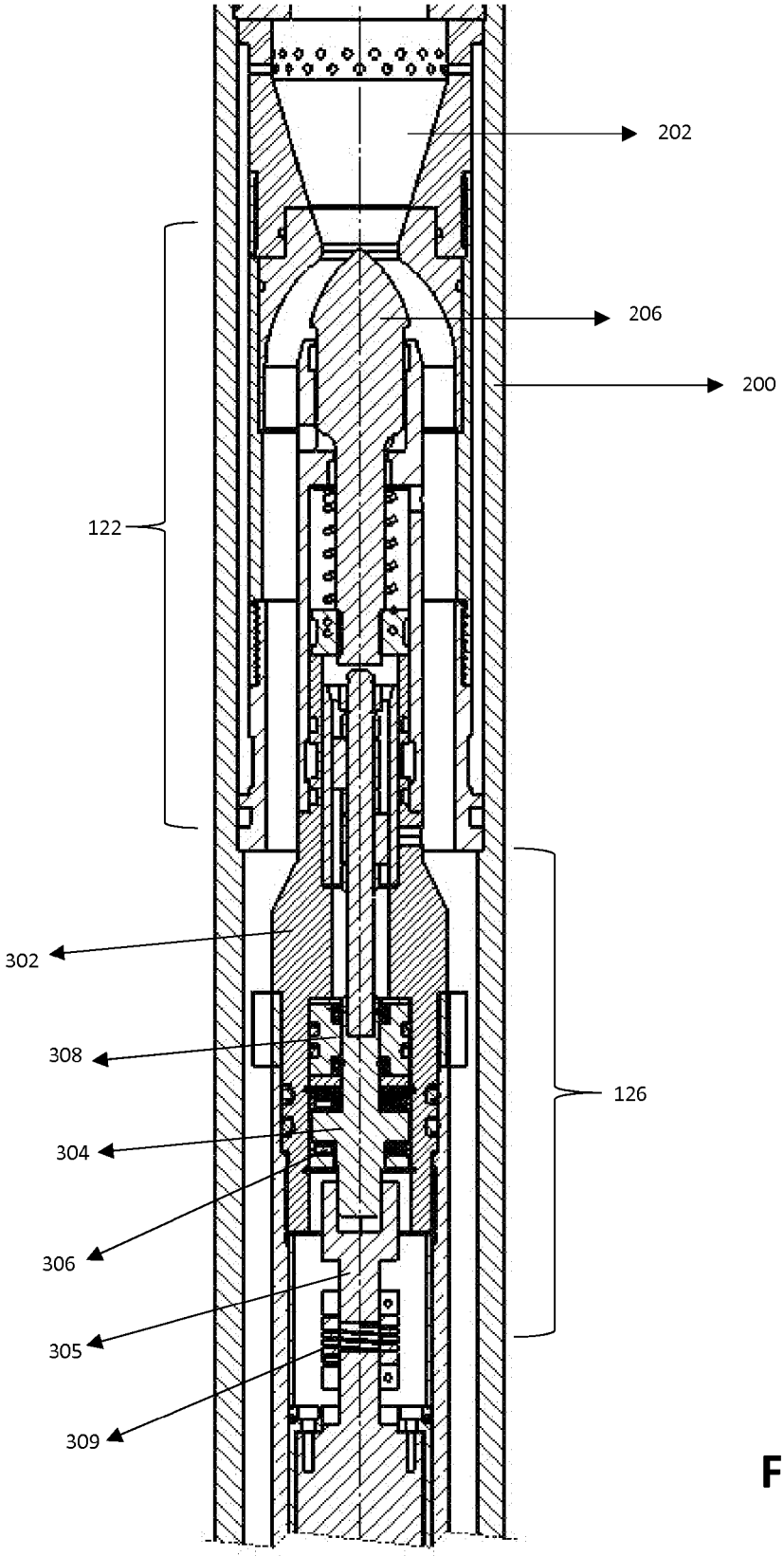
FIG. 3*a* is an enlarged cross-sectional view of the pilot valve section in relation to the main valve section.

The fluid flowing through the interior of the CT-MWD-FTD tool [100] operates the main valve [206], positioned within the upper pipe [200] in the main valve section [122], using pilot fluid channeled through the pilot valve section [126] shown in FIG. 3*a*. The main valve [206] is operated by a hydraulic feed-back controlled by the pilot valve section [126]. The main components of the pilot valve section [126] are enclosed in the pilot valve actuator assembly housing [302]. The rotary seal shaft [304], supported by thrust bearings [306], has a front (smaller) shaft portion that functions within the seal carrier [308] and a back (larger) portion which is attached to a drive shaft [305] with a flex coupling [309]. The pilot fluid continuously flows through the pilot valve section [126] causing the opening or closing of the main valve [206] by using electronic controls.

Figure 3B:
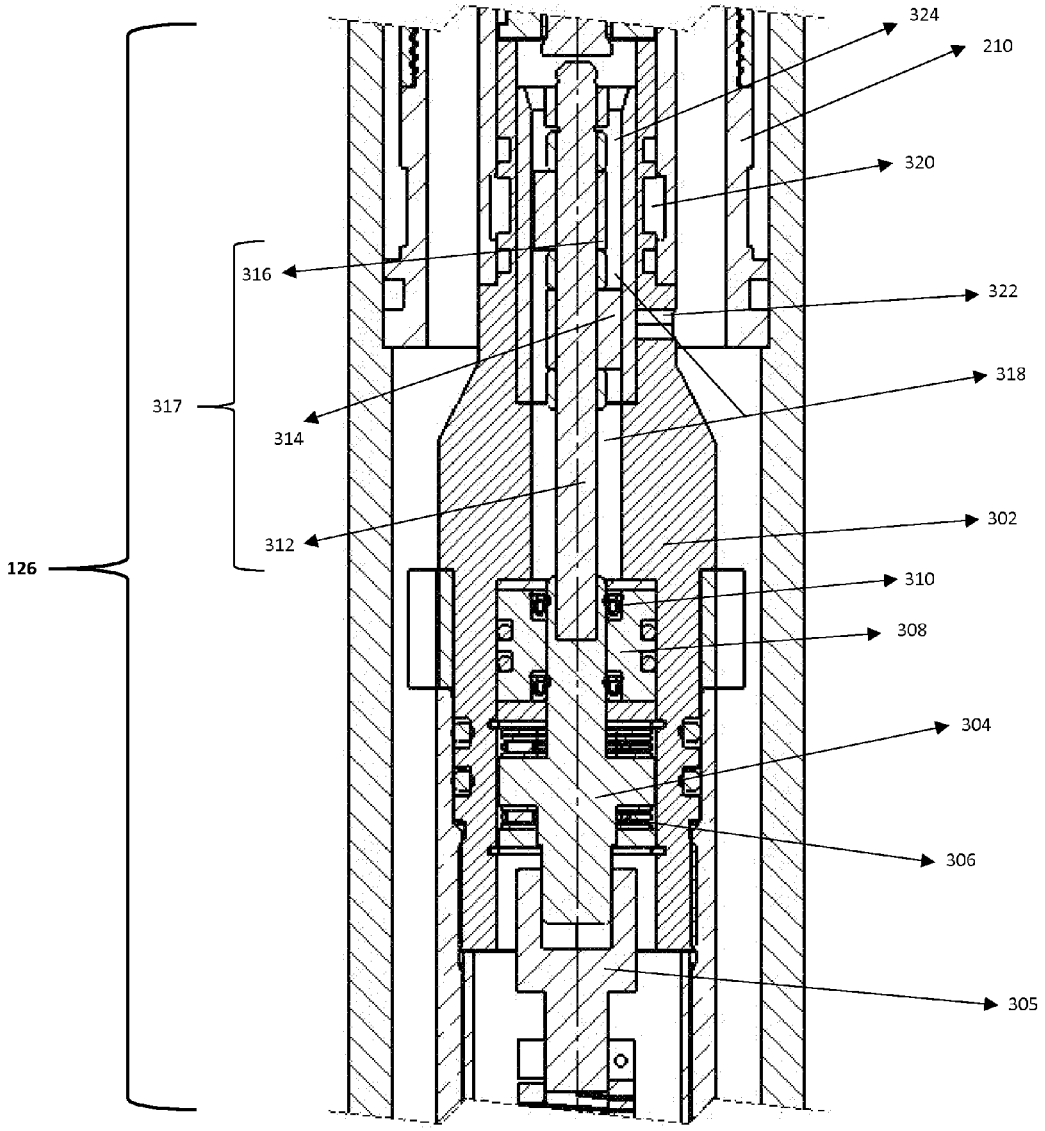
FIG. 3*b* is a more complete view of the pilot valve section.

FIG. 3*b* provides further detail of the pilot valve section [126]. The seal carrier [308] contains the rotary seals [310]. The rotary seal shaft [304], supported by thrust bearings [306], and attached to the drive shaft [305], turns the pilot valve shaft [312] within the pilot valve actuator assembly housing [302]. The pilot valve actuator assembly [302] includes a pilot outlet cam [314] and a pilot inlet cam [316] mounted to the assembly. The combination of the pilot valve shaft, pilot outlet cam and pilot inlet cam (312, 314, 316) provides the pilot valve actuator assembly [317]. The cam valves [314, 316] rotate inside a pilot sleeve [318] which contains additional circular openings (holes) located radially over the cam valves [314, 316] allowing fluid to pass through the cam as the cam valves [314, 316] rotate over or away from the holes in the pilot sleeve [318].

The pilot fluid, with higher pressure than the pressure associated with the main fluid being choked through the main valve housing [210], enters the pilot flow inlet channel [320] where it enters openings in the pilot sleeve [318]. The inlet channel is closed off by the pilot inlet cam [316] which is rotated by the pilot valve shaft [312]. When the pilot valve shaft [312] rotates the pilot inlet cam [316] away from the opening to the pilot flow inlet channel [320], the pilot fluid is able to enter into the interior of the pilot sleeve [318], which is the main valve fluid feed channel [324]. At the same time pilot outlet cam [314] which is rigidly attached to the pilot valve shaft [312] rotates to close off the opening in the pilot sleeve [318] to the pilot flow outlet channel [322]. This allows for capturing the higher pressure pilot fluid inside the pilot sleeve [318] and creates pressure on the main valve plunger [208] which moves the main valve [206] to close the main flow through the main valve orifice [204].

The momentary closure of the main valve [206] builds up the pressure in the upstream fluid flow which travels up to the surface to be detected.

Figure 4:
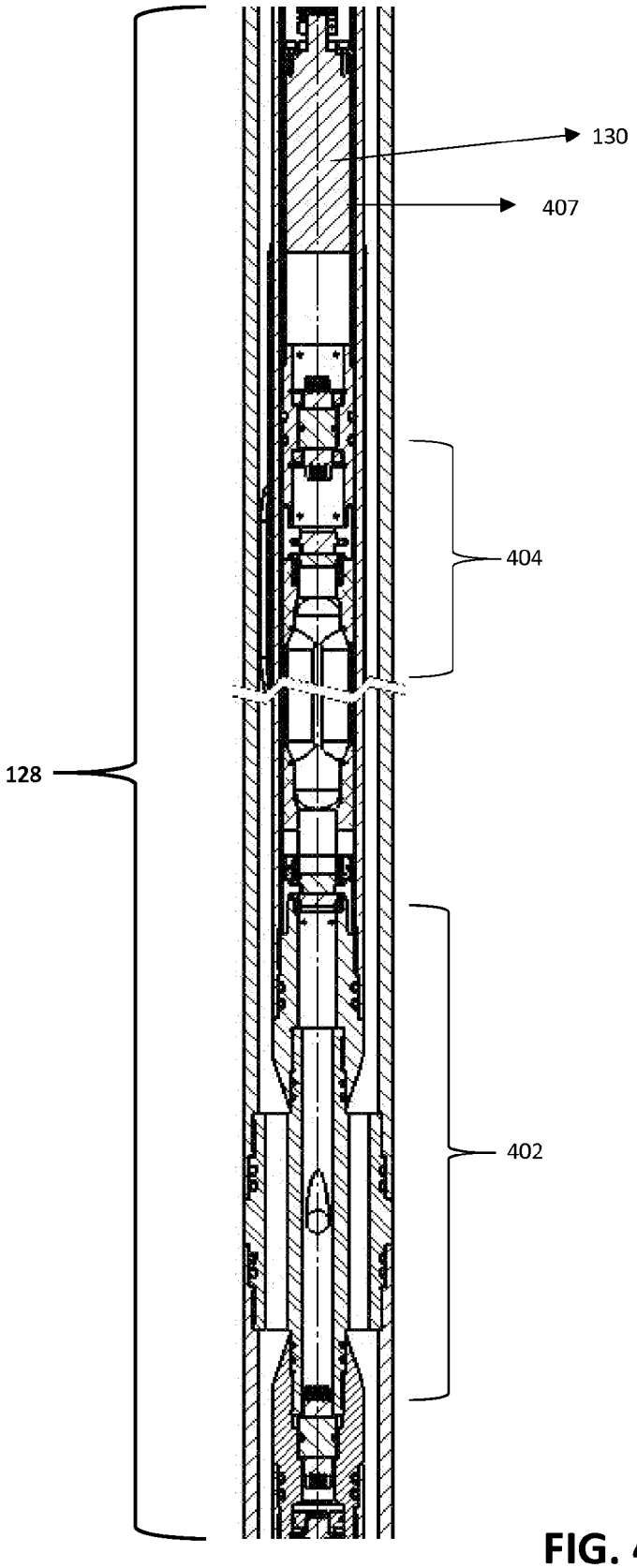
FIG. 4 is a cross-sectional view of the electronics section of the CT-MWD-FTD tool.

FIG. 4 illustrates the electronics section [128] of the CT-MWD-FTD tool [100]. Power is routed in the interior of the assembly through the sensor sub assembly [402] into the electronics [404]. Based on input from the sensor sub assembly [402], the electronics [404] run the motor [130] within the motor housing [407] which in turn rotates the pilot valve shaft [312] according to coding pattern programmed in the electronics [404]. The speed and duration of the pilot inlet cam [316] opening and simultaneously the pilot outlet cam [314] closing is controlled by the electronics [404] based on preprogrammed pattern and sensor input data. After a pressure pulse was created the motor [130] rotates the pilot valve shaft [312] through the rotary seal shaft [304] and the drive shaft [305] to move the pilot inlet cam [316] to close off the inflow of the pilot fluid into the interior chamber of the pilot sleeve [318], and simultaneously move the pilot outlet cam [314] to open to the pilot flow outlet channel [322] where the pilot fluid trapped in the interior of the pilot sleeve [318] can escape into the main fluid flow area and allows the main valve plunger [208] to retract with spring assistance. The rate of opening and closing of the valves is dictated by the encoded information the CT-MWD-FTD tool [100] is sent up to the surface via mud pulses.

The CT-MWD-FTD tool [100] is also equipped with the necessary sensors needed for the operator to know down conditions while drilling. The pressure sensors and the weight-on-bit and torque sensors are located in the Sensor sub assembly [402] and connected by wires running on the concentric center of the CT-MWD [100] tool to the electronics [404]. The temperature sensor and inclination sensor are also located in the electronics section [128].

Figure 5:
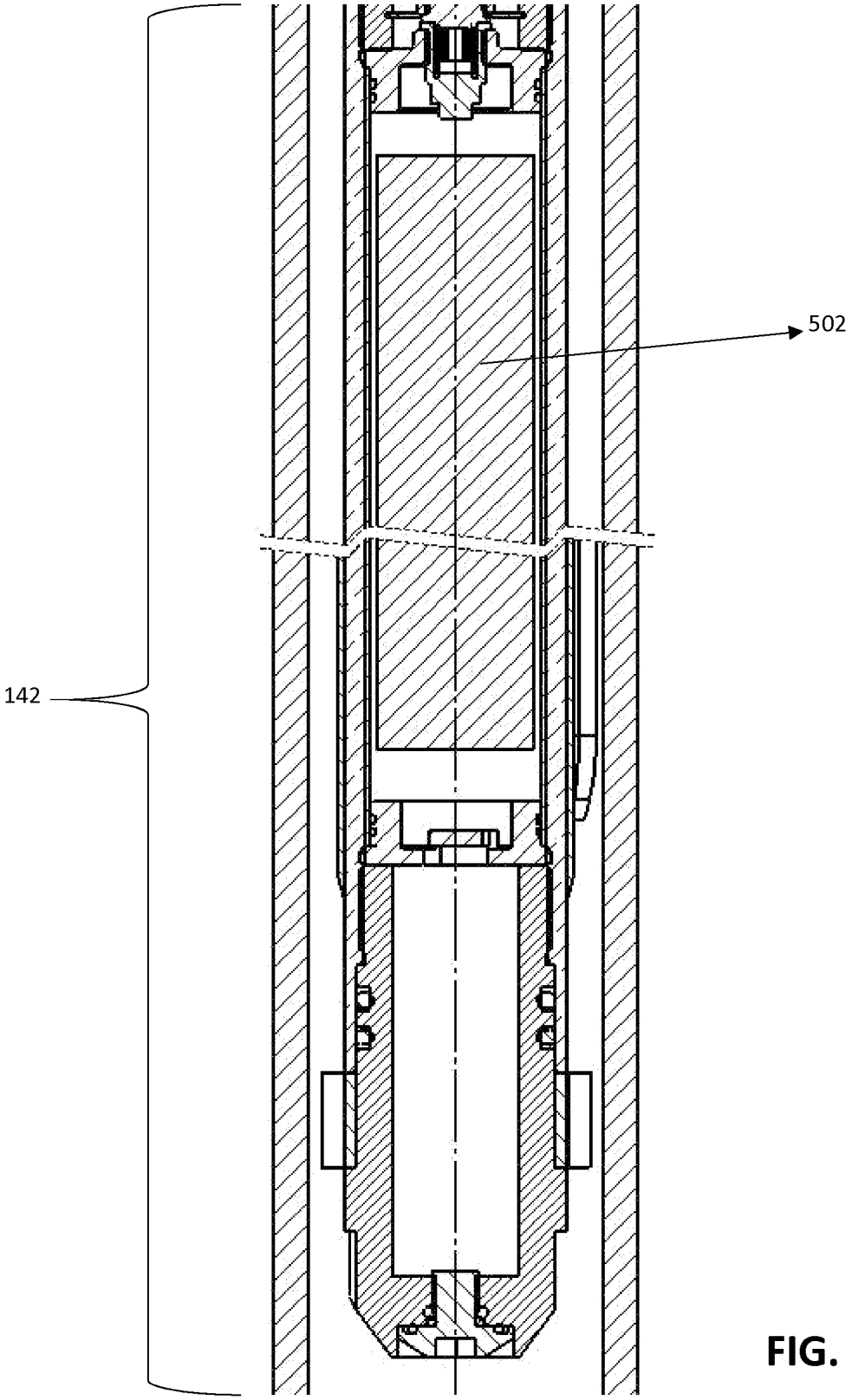
FIG. 5 is an illustrated view of the power unit or battery section of the CT-MWD-FTD tool.

FIG. 5 provides the power unit or battery section [142] containing the battery [502], or in place of the battery [502] a down hole turbine (not pictured, but an included embodiment) to power the CT-MWD-FTD tool [100]. The battery [502] is located below the sensor sub assembly [402] sub and wired through the center of the sensor sub assembly [402] to provide power to the Electronics [404]. Additional sensors such as a casing collar locator (CCL) or gamma module can be added between the sensor sub assembly [402] and the battery [502] as needed.

The annulus pressure sensor measures the fluid pressure on the outside of the CT-MWD-FTD tool [100] where the drilling fluid (mud) is returning to the surface, while the bore pressure sensor is measuring the drilling fluid pumped down in the inside of the coiled tubing. These two measurements are the primary indicators for drilling/milling operation. The difference between these two pressures drives the drilling/milling operation. The CT-MWD-FTD tool [100] sends this information up to the operator in real time via positive mud pulse telemetry and also records it and uses it to make adjustments in the pulse rate or amplitude mode.

The weight-on-bit force and torque sensors detect the drilling/milling progress which data is also sent to the operator real time via mud pulse and recorded. In order to maintain optimal weight (force) on the bit, the CT-MWD-FTD tool [100] could be programmed to adjust the pressure pulses of the main valve [200] to produce the necessary axial reaction force. This can be done by pre-programming the tool to operate automatically based on preset conditions. The pulsing function, amplitude, rate or duration can also be manually adjusted during operation via down linking by altering the pump fluid pressure that the CT-MWD-FTD tool [100] detects and responds to accordingly.

When the pulsing mode is completely turned off, the CT-MWD-FTD tool [100] acts as a memory only logging tool, recording the down hole conditions from all the sensor inputs for it to be downloaded from the tool memory after operation.

The pulsing mode can also be programmed to pulse a constant pattern without coded telemetry to provide axial agitation to the tool and the coiled tubing to reduce friction. This mode could be preset or downlinked as required to the tool during operation. A simple version of the CT-MWD-FTD tool [100] without the sensors having only a motor control of the pulser could provide a simpler and more economical alternative for friction reduction effect only.

A purely mechanical version of the tool where the main flow operates the main valve in a preset frequency is another variation of the tool that provides only axial agitation for friction reduction. Not having electronics, motor or battery this version of the tool is more economical for agitation of the coiled tubing only. The main flow of the fluid can rotate the pilot valve actuator assembly either by a turbine or a screw.

We claim:

1. An apparatus for generating pressure pulses in a drilling fluid that is flowing, enhancing, and completing a well bore within a coiled tubing assembly comprising:

a coiled tubing—measurement while drilling flow throttling device (CT-MWD-FTD) tool longitudinally and axially positioned within a center of a main valve assembly including a main valve, wherein said main valve assembly also comprises a main valve pressure chamber, and a main valve orifice with said main valve, such that said drilling fluid splits into both an inlet main fluid stream and a pilot fluid stream, and wherein said pilot fluid stream flows through a pilot flow upper annulus, through a pilot flow lower annulus and into a pilot flow inlet channel, via a pilot valve actuator assembly that is selected from one or more of the group consisting of: a pilot valve shaft, a rotary seal shaft, rotary seals, a seal carrier, a cam shaft, pilot cams, a pilot sleeve, a pilot valve actuator assembly housing with both pilot inlet and pilot outlet channels and a main valve with an attached spring assisted plunger wherein said pilot fluid stream then flows into a main valve fluid feed channel until it reaches said main valve pressure chamber such that said pilot fluid stream flows into said main valve fluid feed channel through a pilot flow outlet channel such that said pilot fluid stream recombines with a main fluid flow to become a main exit fluid flow such that said main exit fluid flow then passes around a coupling mechanism toward a motor housing wherein a motor in said motor housing is connected to a mechanical drive shaft, with a pilot sleeve within which pilot cams are attached to said drive shaft such that said cams are allowed to move and wherein said pilot cams are sized and oriented within said pilot sleeve in order to provide a path within said pilot sleeve that allows said pilot valve shaft to move in a bi-directional motion that either opens or seals inlet and/or outlet pilot flow channels and wherein one or more annular pressure sensors measuring a pressure of flowing fluid is located inside a sensor sub assembly with sensors that send signals to a Digital Signal Processor (DSP) that controls CT-MWD-FTD tools that generate controllable, large, measurable, rapid energy pulses.

2. The apparatus of claim 1, wherein rotational motion of said motor is connected to a rotary shaft, wherein said shaft rotates and is connected to and moves [said] pilot cams, and also channels said pilot fluid stream toward said main valve causing said main valve to close and also allow said pilot fluid stream to move said main valve into said main valve orifice thereby simultaneously generating a positive fluid pulse and reversing rotation of said rotary shaft, and wherein said pilot cams subsequently channel said pilot fluid stream away from said main valve, causing said pilot valve actuator assembly to move away from said main valve orifice, thereby completing a positive fluid pulse.

3. The apparatus of claim 1, wherein said apparatus generates fluid pulses such that said CT-MWD-FTD tool using said pilot valve actuator assembly provides either unidirectional or bi-directional rotary movement of said pilot valve shaft within said pilot valve actuator assembly housing.

4. The pulses of claim 1, wherein said pulses provide fully developed signals distinguishable from noise resulting from vibrations due to nearby equipment within said well bore or exterior to said wellbore, or within a coiled tubing assembly, wherein said pulses create signals capable of providing indications regarding dimensions of height, width and shape of said pulses.

5. The apparatus of claim 1, wherein a mating area for electrical wiring of said annular pressure sensors exist within annular pressure ports and wherein said ports are sealed off insuring that said annular pressure sensors receive and sense only an annular pressure within said annular pressure ports.

6. The apparatus of claim 1, wherein a mating area for electrical wiring for bore pressure sensors exist within bore pressure ports and wherein said ports are sealed off insuring that said bore pressure sensors receive and sense only bore pressure within said bore pressure ports.

7. The apparatus of claim 1, wherein a mating area for electrical wiring for weight-on-bit/axial force sensors exist within force sensor ports wherein said force sensor ports are sealed off, insuring that said force sensors receive and sense only a force within said force sensor ports.

8. The apparatus of claim 1, wherein a mating area for electrical wiring for torque sensors exist within torque sensor ports wherein said ports are sealed off, insuring that said torque sensors receive and sense only torque within said torque sensor ports.

9. The apparatus of claim 1, wherein electrical wiring for said annular pressure sensors are sealed off from flow of said main exit fluid flow and wherein said wiring is routed to and connected to an electrical connector.

10. The apparatus of claim 1, wherein electrical wiring of bore pressure sensors is sealed off from flow of said main exit fluid flow and wherein said wiring is routed to and connected to an electrical connector.

11. The apparatus of claim 1, wherein electrical wiring of weight-on-bit/force sensors is sealed off from flow of said main exit flow fluid and wherein said wiring is routed to and connected to an electrical connector.

12. The apparatus of claim 1, wherein electrical wiring of torque sensors are sealed off from flow of said main exit fluid flow and wherein said wires are routed to and connected to an electrical connector.

13. The apparatus of claim 1, wherein said apparatus provides a flow path allowing flow of said pilot fluid through said pilot valve actuator assembly, channeling said pilot fluid toward said main valve resulting in operation of said pilot valve actuator assembly in a bi-directional axial direction.

14. The apparatus of claim 1, wherein differential pressure is maximized by using a flow cone wherein said flow cone resides above said main valve allowing for increasing velocity of said drilling fluid through said main valve orifice which increases a pressure differential and controllability of energy pulses created by opening and closing of said main valve by said pilot valve actuator assembly.

* * * * *